US009605686B2

(12) United States Patent
Hamada et al.

(10) Patent No.: US 9,605,686 B2
(45) Date of Patent: Mar. 28, 2017

(54) AXIAL FLOW FAN AND AIR-CONDITIONING APPARATUS HAVING THE SAME

(71) Applicant: Mitsubishi Electric Corporation, Tokyo (JP)

(72) Inventors: Shingo Hamada, Tokyo (JP); Seiji Nakashima, Tokyo (JP); Takashi Ikeda, Tokyo (JP); Takahide Tadokoro, Tokyo (JP); Takuya Kodama, Tokyo (JP); Takashi Kobayashi, Tokyo (JP); Hiroshi Yoshikawa, Tokyo (JP); Hiroaki Makino, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 420 days.

(21) Appl. No.: 14/447,977

(22) Filed: Jul. 31, 2014

(65) Prior Publication Data

US 2015/0044058 A1 Feb. 12, 2015

(30) Foreign Application Priority Data

Aug. 8, 2013 (JP) ..... 2013-165454

(51) Int. Cl.
*F04D 29/38* (2006.01)
*F24F 1/38* (2011.01)
(Continued)

(52) U.S. Cl.
CPC ..... *F04D 29/384* (2013.01); *F04D 29/386* (2013.01); *F24F 1/38* (2013.01);
(Continued)

(58) Field of Classification Search
CPC ..... F04D 29/384; F04D 29/386; F05D 2240/303; F05D 2240/304
(Continued)

(56) References Cited

U.S. PATENT DOCUMENTS 77,888 A * 5/1868 Kennedy ..... F04D 29/384 416/238
1,895,252 A * 1/1933 Kontos ..... B64C 11/16 416/242
2015/0044058 A1 2/2015 Hamada et al.

FOREIGN PATENT DOCUMENTS

CN 204239327 U 4/2015
EP 2 607 714 A2 6/2013
(Continued)

OTHER PUBLICATIONS

Office Action issued Nov. 10, 2015 in the corresponding JP application No. 2013-165454 (with English translation).
(Continued)

*Primary Examiner* — John K Fristoe, Jr.
*Assistant Examiner* — Behnoush Haghighian
(74) *Attorney, Agent, or Firm* — Posz Law Group, PLC

(57) ABSTRACT

A leading edge of a blade has a first curved portion provided with a leading-edge rearmost point, and a trailing edge of the blade has a second curved portion located on the inner circumferential side of the trailing edge and a third curved portion located on the outer circumferential side of the blade on the trailing edge. The third curved portion has a trailing-edge foremost point, and the second curved portion has a trailing-edge rearmost point. The trailing edge and a first concentric circle, which is one of concentric circles having as their center an axis of rotation and passes through the leading-edge rearmost point, intersect each other at a first intersection. The first intersection is located between the trailing-edge rearmost point and the trailing-edge foremost point.

13 Claims, 17 Drawing Sheets

(51) Int. Cl.
*F04D 19/00* (2006.01)
*F24F 1/06* (2011.01)

(52) U.S. Cl.
CPC ..... *F04D 19/002* (2013.01); *F05D 2240/303* (2013.01); *F05D 2240/304* (2013.01); *F05D 2240/307* (2013.01); *F24F 1/06* (2013.01)

(58) Field of Classification Search
USPC ..... 416/242, 238
See application file for complete search history.

(56) References Cited

FOREIGN PATENT DOCUMENTS

| | | | | |
|---|---|---|---|---|
| JP | 2000-018194 | A | | 1/2000 |
| JP | 2005140081 | A | * | 6/2005 |
| JP | 2006-063879 | A | | 3/2006 |
| JP | 2006177205 | A | * | 7/2006 |
| JP | 2010-101223 | A | | 5/2010 |
| JP | 2010-150945 | A | | 7/2010 |
| JP | 2012-012942 | A | | 1/2012 |

OTHER PUBLICATIONS

Office Action dated Apr. 1, 2016 issued in corresponding CN patent application No. 201410389328.7 (and English translation).
Communication pursuant to Article 94(3) EPC issued on Jul. 13, 2016 in corresponding EP patent application No. 14 179 447.9.
Office Action issued Aug. 1, 2016 in the corresponding CN application No. 201410389328.7 (with English translation).
Extended European Search Report dated Jul. 2, 2015 issued in corresponding EP patent application No. 14179447.9.
Shingo Hamada et al., "Aerodynamic Noise Simulation of Propeller Fan by Large Eddy Simulation". Academic Journal of Japan Society of Refrigerating and Air Conditioning Engineers, Jul. 2009, vol. 84, No. 981, p. 34, Fig. 13(d).

* cited by examiner (a)

(b)

AXIAL FLOW FAN AND AIR-CONDITIONING APPARATUS HAVING THE SAME

TECHNICAL FIELD

The present invention relates to an axial flow fan that includes a plurality of blades and an air-conditioning apparatus that includes the axial flow fan.

BACKGROUND ART

FIG. 21 shows schematic views of a related-art axial flow fan.

View (a) of FIG. 21 is a perspective view as seen from the upstream side of a flow of a fluid.

View (b) of FIG. 21 is a front view as seen from the downstream side of the flow of the fluid.

View (c) of FIG. 21 is a front view as seen from the upstream side of the flow of the fluid.

View (d) of FIG. 21 is a side view as seen in a direction late al to the axis of rotation of the axial flow fan.

As illustrated in FIG. 21, the related-art axial flow fan includes a plurality of blades 1 disposed along the circumferential surface of a cylindrical boss 2 of the fan. As a rotational force is applied to the boss 2, the blades 1 rotate in a rotational direction 3 to deliver a fluid in a fluid flow direction 5 in which the fluid flows. Each blade 1 has leading and trailing edges curved concavely in the rotational direction. The above-described structure is also disclosed in, for example, Patent Literature 1 and so forth.

In the axial flow fan, when the blades 1 of the axial flow fan rotate, the fluid present between the blades 1 collides with the blade surfaces. The pressure is increased in the surfaces with which the fluid collides, and the fluid is pushed in the axis of rotation direction and moved.

When the blades 1 rotate, the fluid is affected by the centrifugal force and the shape of the blades 1. Thus, as illustrated in FIG. 22, regions of the blade 1, in which the flow velocity in a direction along an axis of rotation 2*a* is high, are known to gather on the radially outer circumferential side of the blade 1 (for details of actual measured values of the flow velocity distribution in an axial flow fan having a shape illustrated in FIG. 21, see Reito Kucho Gakkai-Shi (Academic Journal of Japan Society of Refrigerating and Air Conditioning Engineers), July 2009, Vol. 84, No. 981, p. 34, FIG. 13 (*d*)).

Since the axial flow fan is disposed in a bell-mouth 13, the fluid flows in the axis of rotation direction instead of spread in the radial directions.

A pressure loss occurs when the flow velocity distribution, in the axial direction, of the blade 1 of the axial flow fan, as illustrated in FIG. 21, varies in each position. This pressure loss will be described hereinafter.

First, a pressure loss ξ of the fluid is given by:

$$\xi = C \times \frac{1}{2} \times \rho \times v^2 \quad \text{[Math. 1]}$$

where C is the pressure loss coefficient, which is approximately 1 for an open space, ρ is the air density, and v is the flow velocity.

Since the velocity distribution of the fluid varies from one position to another position in the radial direction of the blade, the pressure loss ξ is calculated by dividing the fluid into minute regions.

The square of the flow velocity Vrms of the fluid in one of the minute regions is the sum of the square of an average flow velocity Vave and the square of the standard deviation σ, and accordingly, is given by:

$$V_{rms}^2 = V_{ave}^2 + \sigma^2 \quad \text{[Math. 2]}$$

where Vave is the average flow velocity [m/s] of the fluid, and

σ is the standard deviation [m/s], which is an index representing a deviation from the average flow velocity.

Thus, the pressure loss ξ of the fluid is the sum of squares of the flow velocities in the minute regions and given by Math. 3.

The number of minute regions is the number of equally divided regions (in this case, ten equally divided regions) of the blade 1 in the radial direction.

$$\begin{aligned} \xi &= C \times \frac{1}{2} \times \rho \times \frac{(v_1^2 + v_2^2 + v_3^2 + \ldots v_{10}^2)}{10} \\ &= C \times \frac{1}{2} \times \rho \times \frac{1}{10} \times \sum_{i=1}^{10} v_i^2 \\ &= C \times \frac{1}{2} \times \rho \times (v_{ave}^2 + \sigma^2) \end{aligned} \quad \text{[Math. 3]}$$

where

ρ is the air density [kg/m$^3$], v1 to v10 are the local average velocities [m/s] in the case of ten regions equally divided in the radial direction, Vave is the average flow velocity [m/s], and σ is the standard deviation [m/s], which is an index representing a deviation from the average flow velocity.

From Maths. 2 and 3. Math. 4 is obtained to calculate the standard deviation σ [m/s], which is an index representing a deviation from the average flow velocity:

$$\sigma = \sqrt{\frac{1}{N} \sum_{i=1}^{N} (v_i - v_{ave})^2} \quad \text{[Math. 4]}$$

Math. 3, therefore, reveals that, in order to reduce the pressure loss ξ, σ need only be zero. That is, from the viewpoint of reducing the pressure loss, it is advantageous that the velocity distribution, in the axis of rotation direction, over positions in the radial direction of the blade is ideally flat (uniform flow, that is, the flow velocity is uniform in any position in the radial direction). The flat velocity distribution is achieved by equalizing the velocity distribution by decreasing the high velocity area and increasing the low velocity area.

CITATION LIST

Patent Literature

[Patent Literature 1] Japanese Unexamined Patent Application Public ion No. 2012-12942 (see FIG. 4, etc.)

SUMMARY OF INVENTION

Technical Problem

When the velocity distribution, in the axis of rotation direction, is uniform over the positions in the radial direction of the blade as described above, the pressure loss of the axial flow fan can be reduced. However, in the example of the related-art axial flow fan as illustrated in FIG. 21, the velocity distribution, in the axis of rotation direction, over the positions in the radial direction of the blade is uneven; the velocity is high on the outer circumferential side of the blade. This increases the pressure loss when the fluid is blown. Thus, a drive force required for rotating the axial flow fan is increased, and accordingly, the power consumption of the fan motor is increased.

The present invention has been made in order to address the above-described problem, and has as its object to obtain an axial flow fan, with which the power consumption of a drive motor can be reduced, and an air-conditioning apparatus that includes the axial flow fan. In the axial flow fan, the pressure loss of air blown from the fan is reduced by improving the shape of blades of the axial flow fan by increasing or decreasing the blade areas on the inner circumferential side and the outer circumferential side of the blades, so as to flatten the velocity distribution, in the axis of rotation direction, over positions in the radial direction of the blade.

Solution to Problem

An axial flow fan according to the present invention includes a plurality of blades rotated to deliver a fluid from the upstream side to the downstream side of a flow of the fluid in a direction along an axis of rotation. Each of the plurality of blades includes a first curved portion, a second curved portion, and a third curved portion. The first curved portion is formed on a leading edge on a forward side of the blade in a rotational direction in which the blade rotates. The first curved portion protrudes backwards in the rotational direction in a planar image of the blade as projected in the direction along the axis of rotation. The first curved portion has a leading-edge rearmost point as a point of contact where the first curved portion is in contact with a virtual line that extends perpendicularly to the axis of rotation. The second curved portion is formed on a trailing edge on a backward side of the blade in the rotational direction. The second curved portion is located on the inner circumferential side of the trailing edge and protrudes backwards in the rotational direction in a planar image of the blade as projected in the direction along the axis of rotation. The third curved portion is formed on the trailing edge on the backward side of the blade in the rotational direction. The third curved portion is located on the outer circumferential side of the blade on the trailing edge and protrudes forwards in the rotational direction in a planar image of the blade as projected in the direction along the axis of rotation. The third curved portion has a trailing-edge foremost point as a point of contact where the third curved portion is in contact with another virtual line that extends perpendicularly to the axis of rotation. The second curved portion has a trailing-edge rearmost point at which the length of a perpendicular line dropped to the other virtual line that passes through the axis of rotation and the trailing-edge foremost point takes a maximum. A first intersection that is an intersection between the trailing edge and a first concentric circle, which is one of concentric circles having as their center the axis of rotation and passes through the leading-edge rearmost point, is located between the trailing-edge rearmost point and the trailing-edge foremost point.

Advantageous Effects of Invention

With the axial flow fan according to the present invention, the velocity distribution, in the axis of rotation direction, over the positions in the radial direction of the blade is flat, Thus, the pressure loss of the fluid blown from the axial flow fan is decreased, and accordingly, the drive force for rotating the axial flow fan can be reduced.

It should be noted that a "propeller fan" will be taken as an exemplary example of the "axial flow fan" hereinafter.

DESCRIPTION OF EMBODIMENTS

Embodiment 1

The structure of a propeller fan according to Embodiment 1 will be described with reference to FIGS. 1 and 2.

Figure 1:
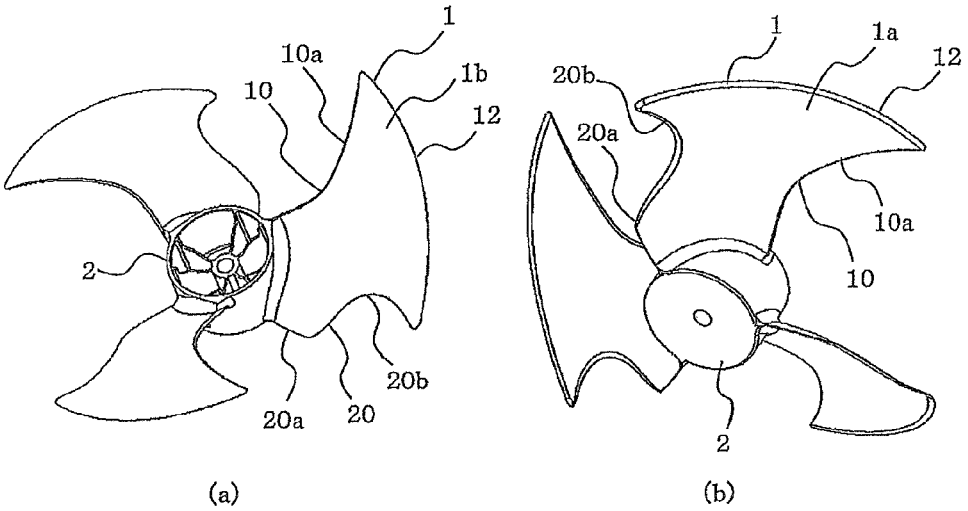
FIG. 1 shows perspective views of a propeller fan according to Embodiment 1.

View (a) of FIG. 1 is a perspective view of the propeller fan according to Embodiment 1 as seen from the upstream side in the direction in which a fluid flows.

Figure 2:
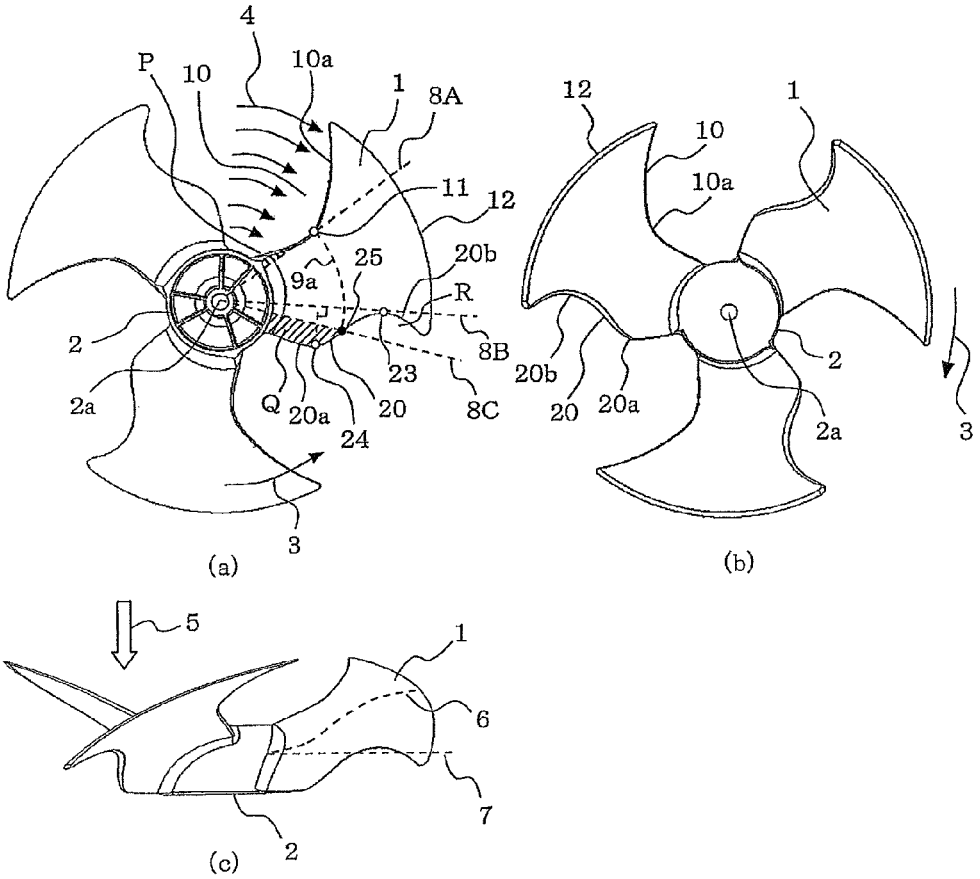
FIG. 2 shows front views and a side view of the propeller fan according to Embodiment 1.

View (b) of FIG. 1 is a perspective view of the propeller fan according to Embodiment 1 as seen from the downstream side in the direction in which the fluid flows, View (a) of FIG. 2 is a front view of the propeller fan according to Embodiment 1 as seen from the upstream side in the direction in which the fluid flows.

View (b) of FIG. 2 is a front view of the propeller fan according to Embodiment 1 as seen from the downstream side in the direction in which the fluid flows.

View (c) of FIG. 2 is a side view of the propeller fan according to Embodiment 1 as seen in a direction lateral to the axis of rotation of the propeller fan.

In the propeller fan according to Embodiment 1, a plurality of blades 1 are fixed to the circumferential wall of a cylindrical boss 2, to be engaged with a drive shaft rotated by a motor or the like, while the boss 2 is positioned at its center. Each blade 1 is slanted at a predetermined angle relative to an axis of rotation 2*a* of the boss 2. As the propeller fan rotates, a fluid present between the blades 1 is pushed by blade surfaces and delivered in a fluid flow direction 5 in which the fluid flows. Note that one surface of each blade 1 that pushes the fluid and rises in pressure will be referred to as a pressure surface 1*a* hereinafter, while the other surface that is formed on the back side of the pressure surface 1*a* and drops in pressure will be referred to as a suction surface 1*b* hereinafter.

The blades 1 rotate in a rotational direction 3 using a rotational force transmitted to the boss 2. Then, the fluid present between the blades 1 flows in on the side of the pressure surface 1*a* in an inflow direction 4.

The shape of each blade 1 is defined by a leading edge 10 on the forward side of the blades 1 in the rotational direction 3 in which the blades 1 rotate, a trailing edge 20 on the backward side in the rotational direction 3 in which the blades 1 rotate, and an outer circumferential edge 12 defining the outer circumference of the blades 1.

The shape of each blade 1 projected in the axis of rotation direction of the boss 2 will be described next.

As illustrated in view (a) of FIG. 2, a first curved portion 10*a* is formed on the leading edge 10 of the blade 1 to have a shape that protrudes backwards in the rotational direction 3 in a planar image of the blade 1 as projected in the axis of rotation direction of the boss 2.

The first curved portion 10*a* of the leading edge 10 has a leading-edge rearmost point 11 as a point of contact where the first curved portion 10*a* is in contact with a virtual line 8, which extends perpendicularly to the axis of rotation 2*a* of the boss 2.

That is, the leading-edge rearmost point 11 is defined as, out of intersections between the first curved portion 10*a* and the virtual line 8 extending perpendicularly to the axis of rotation 2*a* of the boss 2, a rearmost point in the rotational direction 3.

A substantially triangular region P is formed in the blade 1 when the virtual line 8 passes through the leading-edge rearmost point 11. The region P is surrounded by a virtual line 8A, the leading edge 10, and the circumferential surface of the boss 2. The region P is represented by hatching in view (a) of FIG. 2.

Also in the blade 1, a second curved portion 20*a* and a third curved portion 20*b* are formed on the trailing edge 20 on the backward side in the rotational direction 3. In a planar image of the blade 1 as projected in the direction along the axis of rotation 2*a* of the boss 2, the second curved portion 20*a* is located on the inner circumferential side of the trailing edge 20 and protrudes backwards in the rotational direction 3, and the third curved portion 20*b* is located on the outer circumferential side of the blade 1 on the trailing edge 20 and protrudes forwards in the rotational direction 3.

The third curved portion 20*b* has a trailing-edge foremost point 23 as a point of contact where the third curved portion 20*b* is in contact with a virtual line 8B, which extends perpendicularly to the axis of rotation 2*a* of the boss 2.

The second curved portion 20*a* has a trailing-edge rearmost point 24. The distance between the second curved portion 20*a* and the virtual line 8B, which passes through the axis of rotation 2*a* of the boss 2 and the trailing-edge foremost point 23, along a line perpendicular to the virtual line 8B is longest at the trailing-edge rearmost point 24.

A first intersection 25 is an intersection between the ailing edge 20 and a first concentric circle 9*a*, which is one of concentric circles about the axis of rotation 2*a* of the boss 2 and passes through the leading-edge rearmost point 11. The first intersection 25 is located between the trailing-edge rearmost point 24 and the trailing-edge foremost point 23.

That is, a region Q is formed on the inner circumferential side of the trailing edge 20 of the blade 1. The region Q is surrounded by the second curved portion 20*a* and a virtual line 8C that passes through the first intersection 25. The region Q is defined with respect to the virtual line 8C and serves as an increment by which the area of the blade 1 increases. The region Q is represented by hatching in view (a) of FIG. 2.

Furthermore, a region R is formed on the outer circumferential side of the blade 1 on the trailing edge 20 of the blade 1. The region R is surrounded by the third curved portion 20*b* and the virtual line 8C that passes through the first intersection 25. The region R is defined with respect to the virtual line 8C and serves as a decrement by which the area of the blade 1 decreases.

The shape of each blade 1 projected in a direction perpendicular to the axis of rotation 2*a* of the boss 2 will be described next.

View (c) of FIG. 2 illustrates a chord center line 6 and a perpendicular plane 7 that extends from a position where the chord center line 6 intersects with the circumferential surface of the boss 2 in a direction perpendicular to the axis of rotation 2*a* of the boss 2. The fluid flows in the fluid flow direction 5.

Figure 3:
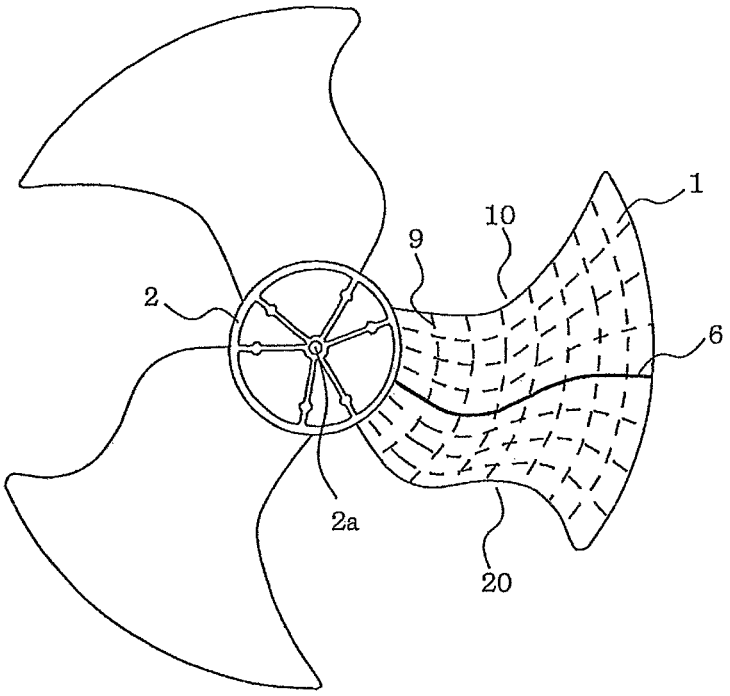
FIG. 3 illustrates the position of a chord center line according to Embodiment 1.

FIG. 3 is a view for explaining the position of the chord center line 6 according to Embodiment 1.

As illustrated in FIG. 3, the chord center line 6 is defined as a curve formed of midpoints, on concentric circles 9 having as their center the axis of rotation 2*a* of the boss 2, between intersections of the leading edge 10 and the concentric circles 9 and intersections of the trailing edge 20 and the concentric circles 9.

In Embodiment 1, the blade 1 has a shape in which the chord center line 6 is located upstream of the perpendicular plane 7 in the flow of the fluid (to be referred to as a "forward swept shape" hereinafter).

The distribution of the velocity distribution, in the axial direction, of each blade 1 of the propeller fan having such a structure will be described with reference to FIG. 4.

Figure 4:
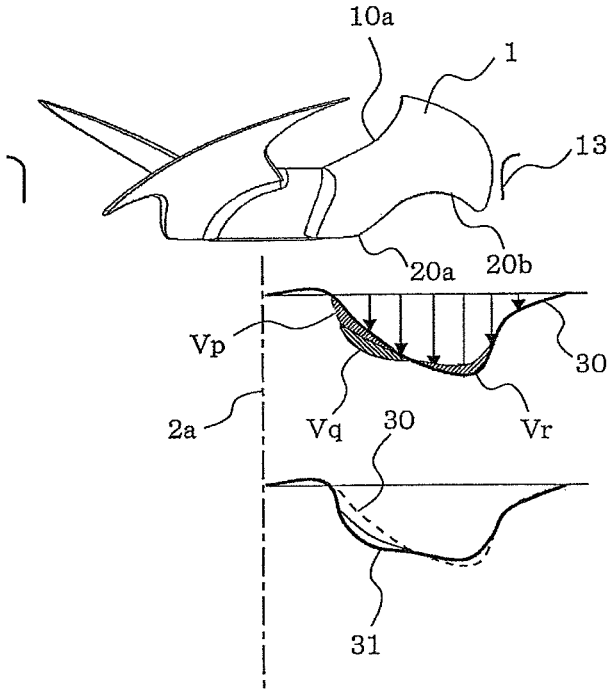
FIG. 4 illustrates the velocity distribution of the flow in a direction along an axis of rotation over the positions in the radial direction of a blade of the propeller fan according to Embodiment 1.

Referring to FIG. 4, horizontal axis represents the velocity distribution of the flow in the axis of rotation direction over the positions in the radial direction of the blade of the propeller fan of Embodiment 1.

The velocity distribution 30 (forward swept shape) represented by a broken line is obtained when the blade 1 does not have the set of regions P, Q, and R, and the velocity distribution 31 (corrected, forward swept shape) represented by the solid line is obtained when the blade 1 has the set of regions P, Q, and R.

In Embodiment 1, since the regions P, Q, and R are set on the blade surface, the effects of increasing or reducing the flow velocity are produced in the velocity distribution to obtain a region Vp in which the flow velocity is increased by the effect of the region P, a region Vq in which the flow velocity is increased by the effect of the region Q, and a region Vr in which the flow velocity is reduced by the effect of the region R.

The above description reveals that, when the blade 1 does not have the set of regions P, Q, and R, the flow velocity is higher on the outer circumferential side of the blade 1, and, when the blade 1 has the set of regions P, Q, and R, a high flow velocity region is formed on the inner circumferential side of the blade 1 and the velocity is reduced in a high flow velocity region on the outer circumferential side of the blade 1.

Since the flow velocity distribution is flat as described above, the pressure loss of air blown from the propeller fan is reduced, and accordingly, a drive force for rotating the propeller fan can be reduced. Thus, the power consumption of the motor can be reduced,

Embodiment 2

In Embodiment 1, in the example of the shape of the blade 1 of the propeller fan, the first intersection 25 that is an intersection between the trailing edge 20 and the first concentric circle 9*a*, which has as its center the axis of rotation 2*a* of the boss 2 and passes through the leading-edge rearmost point 11, is located between the trailing-edge rearmost point 24 and the trailing-edge foremost point 23. In Embodiment 2, the structure according to Embodiment 1 is more specifically defined in terms of the relationship between the first intersection 25 and the shape of the trailing edge 20

Figure 5:
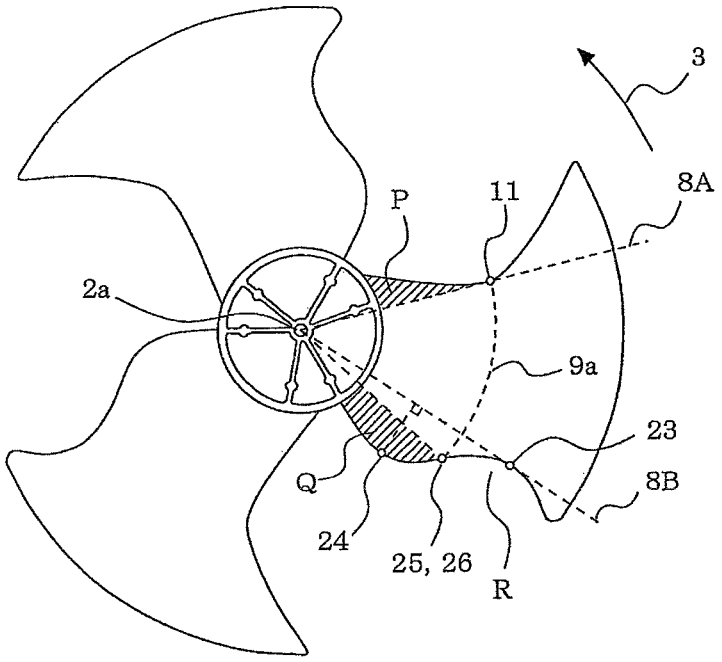
FIG. 5 is a front view of a propeller fan according to Embodiment 2 as seen from the upstream side in the direction in which a fluid flows.

FIG. 5 is a front view of a propeller fan according to Embodiment 2 as seen from the upstream side in the direction in which the fluid flows.

Referring to FIG. 5, as in the structure defined in Embodiment 1, each blade 1 has a leading-edge rearmost point 11, a trailing-edge foremost point 23, a trailing-edge rearmost point 24, and a first intersection 25.

In this case, however, an inflection point 26 is additionally defined. A second curved portion 20*a* and a third curved portion 20*b* of a trailing edge 20 are connected to each other at the inflection point 26.

In Embodiment 2, the blade 1 has a shape in which the first intersection 25 and the inflection point 26 are located at the same position on the trailing edge 20. That is, the inflection point 26 is located on a first concentric circle 9*a*, which has as its center an axis of rotation 2*a* and passes through the leading-edge rearmost point 11.

Note that, as described above, a region P increases the flow quantity on the inner circumferential side of the blade 1 and a region R decreases the flow quantity on the outer circumferential side of the blade 1. Thus, the velocity distribution is equalized. That is, since the effect produced by the region P and the effect produced by the region R are opposite to each other in terms of changes in flow quantity, when the inflection point 26 is more to the inner circumferential side than the first intersection 25, the flow rate increased by the region P is decreased by the region R.

This unnecessarily reduces, using the trailing edge 20, the flow rate increased using the leading edge 10, and accordingly, is inefficient from the viewpoint of equalizing the velocity distribution of the blade 1.

Since the leading-edge rearmost point 11 and the inflection point 26 are located on the first concentric circle 9*a* in Embodiment 2, the flow rate increased by the leading edge 10 is not decreased by the trailing edge 20 and remains effective. Since regions where the flow rate is low can be efficiently increased and regions where the flow rate is high can be efficiently reduced, the velocity distribution can be equalized. With this arrangement, the drive force for rotating the propeller fan can be reduced to, in turn, reduce the power consumption of the motor.

Embodiment 3

In Embodiment 3, the relationship between the first intersection 25 and the shape of the trailing edge 20 in Embodiments 1 and 2 are more specifically defined.

Figure 6:
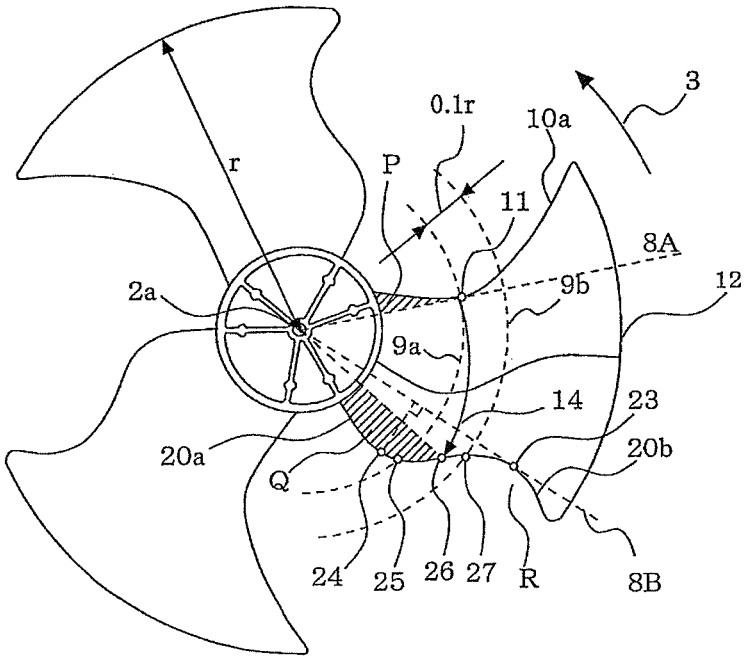
FIG. 6 is a front view of a propeller fan according to Embodiment 3 as seen from the upstream side in the direction in which a fluid flows.

FIG. 6 is a front view of a propeller fan according to Embodiment 3 as seen from the upstream side in the direction in which the fluid flows.

Referring to FIG. 6, as in the structures defined in Embodiments 1 and 2, each blade 1 has a leading-edge rearmost point 11, a trailing-edge foremost point 23, a trailing-edge rearmost point 24, a first intersection 25, and an inflection point 26.

Figure 7:
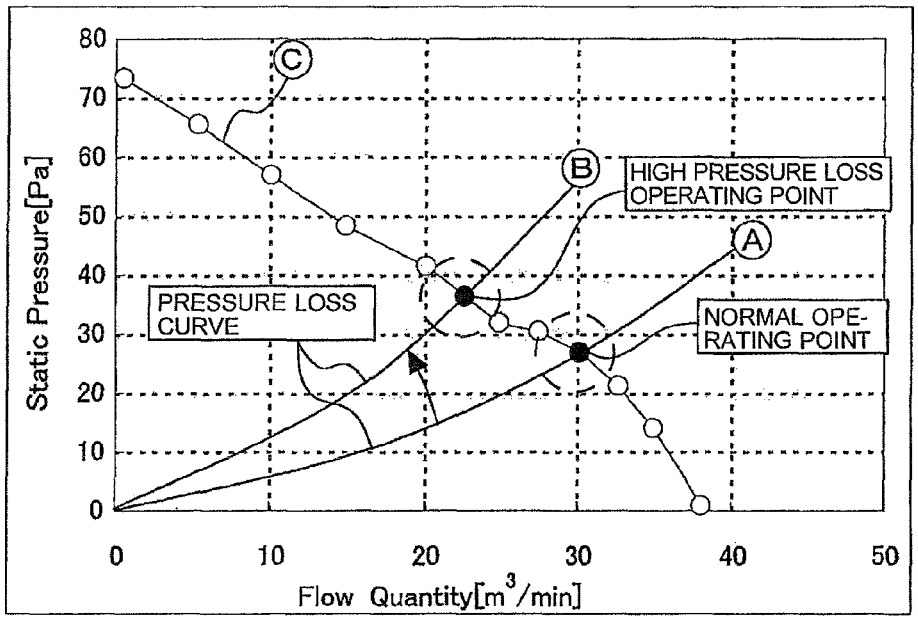
FIG. 7 is a pressure-quantity (P-Q) chart that represents the air sending performance of the propeller fan.

FIG. 7 is a pressure-quantity (P-Q) chart that represents the air sending performance of the propeller fan.

In general, the air sending performance of the propeller fan is represented by the relationship between the pressure (static pressure) of a fluid and the flow quantity per unit time (P-Q chart) as illustrated in FIG. 7. It is known that, when resistance in the passage of air blown by the propeller fan is high, the pressure loss curve rises from a normal pressure loss curve A to a high pressure loss curve B, and an operating point, which is an intersection between the pressure loss curve and a capacity-characteristic curve C of the propeller fan, also shifts. The pressure loss represented by the high pressure loss curve B is twice the pressure loss represented by the normal pressure loss curve A in a flow passage.

An intersection between the normal pressure loss curve A and the capacity-characteristic curve C is a normal operating point, and an intersection between the high pressure loss curve B and the capacity-characteristic curve C is a high pressure loss operating point.

Figure 8:
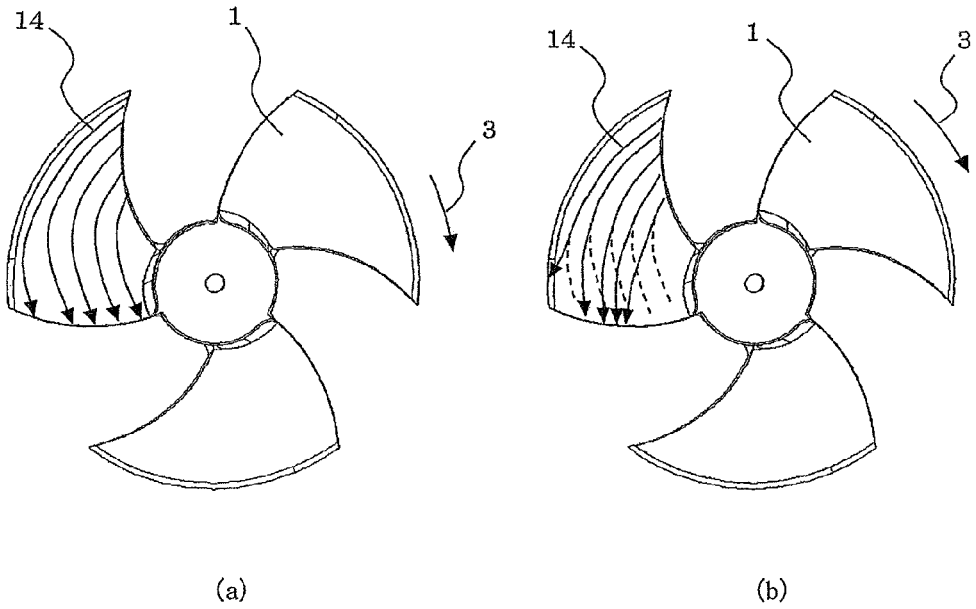
FIG. 8 illustrates views of streamline limits on the pressure surface side of the blades of the propeller fan.

FIG. 8 illustrates the results of a numerical fluid dynamics analysis performed on streamline limits 14 of a blade surface corresponding to a pressure surface 1*a* of the blade 1 when the pressure loss is high in the flow passage and when the pressure loss is low in the flow passage. Note that the streamline limits 14 are drawn by connecting vectors of the flow velocities of streams flowing near the surface with lines.

View (a) of FIG. 8 is a schematic view illustrating the streamline limits 14 on the pressure surface 1*a* at the normal operating point. View (b) of FIG. 8 is a schematic view of the streamline limits 14 at the high pressure loss operating point.

Dotted lines in view (b) of FIG. 8 represent the streamline limits 14 at the normal operating point.

Obviously, in the case of the high pressure loss operating point, the streamline limits 14 shift to the outer circumferential side of the blade 1 relative to those in the case of the normal operating point.

That is, in operating the propeller fan, when a high static-pressure fan is required due to a high pressure loss caused by the resistance in the flow passage, the path of the streamline limit 14 on each blade 1 of the propeller fan is as follows: that is, as illustrated in view (b) of FIG. 8, the fluid having flowed in through the leading-edge rearmost point 11 shifts more to the outer circumferential side than the leading-edge rearmost point 11 on the concentric circle and deviates from a trailing edge 20.

Thus, the blade 1 according to Embodiment 3 has, as illustrated in FIG. 6, the following structure. That is, letting r be the radius of the propeller fan, which is represented as the length from an axis of rotation 2*a* to an outer circumferential edge 12 of the blade 1, an intersection between the trailing edge 20 and a first concentric circle 9*a*, which has as its center the axis of rotation 2*a* and passes through the leading-edge rearmost point 11, is defined as the first intersection 25, and an intersection between the trailing edge 20 and a second concentric circle 9*b*, with a radius larger than that of the first concentric circle 9*a* by 0.1r, is defined as a second intersection 27, the inflection point 26, which connects the second curved portion 20*a* and the third curved portion 20*b* to each other, is located between the first intersection 25 and the second intersection 27.

It has been clarified by the result of the numerical fluid dynamics analysis that the path of the streamline limit 14 of the fluid having flowed through the leading-edge rearmost point 11 shifts to the outer circumferential side in a region on the inner circumferential side of the second concentric circle 9*b*, with a radius larger than that of the first concentric circle 9*a* by 0.1r.

As described above, in Embodiment 3, the inflection point 26 is positioned more to the outer circumferential side of the blade 1 than the first intersection 25. Thus, even when the streamline limits 14 shift to the outer circumferential side, the flow quantity increased by the region P is not decreased by the region R.

That is, since the blade 1 has a shape in which the inflection point 26 is located between the first intersection 25 and the second intersection 27, when the propeller fan is used as a high static-pressure propeller fan with which the streamline limits 14 shift to the outer circumferential side of the blade 1, the flow velocity distribution of the fluid can be flattened. Thus, the pressure loss of the fluid blown from the propeller fan is reduced to, in turn, reduce the drive force for rotating the propeller fan. This reduces the power consumption of the motor.

Embodiment 4

In Embodiment 1, the blades 1 of the propeller fan have the forward swept shape. In Embodiment 4, the blades 1 of the propeller fan have a backward swept shape.

Figure 9:
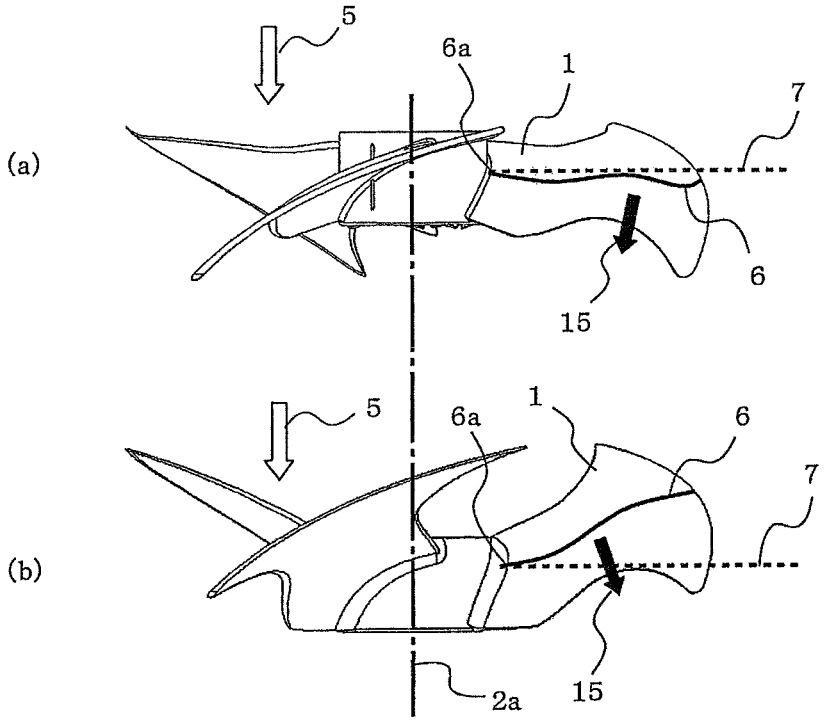
FIG. 9 shows side views of a propeller fan according to Embodiment 4, and illustrates the position of a chord center line.

View (a) of FIG. 9 is a side view of the propeller fan according to Embodiment 4. In view (a) of FIG. 9, the position of a chord center line 6 is illustrated.

In view (a) of FIG. 9, the chord center line 6 is located downstream of a perpendicular plane 7 in the flow of the fluid. The perpendicular plane 7 extends in a direction perpendicular to an axis of rotation 2*a* of a boss 2 from a contact point 6*a* where the chord center line 6 abuts against the circumferential wall of the boss 2.

Thus, in Embodiment 4, the blade 1 has a shape in which the chord center line 6 is located downstream of the perpendicular plane 7 in the flow of the fluid (to be referred to as a "backward swept shape" hereinafter).

For comparison, in the forward swept propeller fan illustrated in view (b) of FIG. 9, the chord center line 6 is located upstream of the perpendicular plane 7 in the flow of the fluid.

An arrow illustrated in view (a) of FIG. 9 indicates a fluid pushing direction 15 in which the fluid is pushed when the blade 1 rotates. The fluid flows in a path inclined toward the inner circumferential side (closed flow) of the blade 1.

For comparison with the contrast, in the forward swept propeller fan is illustrated in view (b) of FIG. 9, the direction in which the fluid is pushed is inclined toward the outer circumferential side of the blade 1 (open flow).

The difference in velocity distribution in a direction perpendicular to the axis of rotation between the forward and backward swept propeller fans will be described next with reference to FIG. 10.

The velocity distribution of the forward swept propeller fan is, as illustrated in FIG. 4, almost flat and improved by the effects of increasing or decreasing the velocity produced by the regions P, Q, and R of the blade 1. Despite this, a high-velocity region remains on the outer circumferential side of the blade 1.

Figure 10:
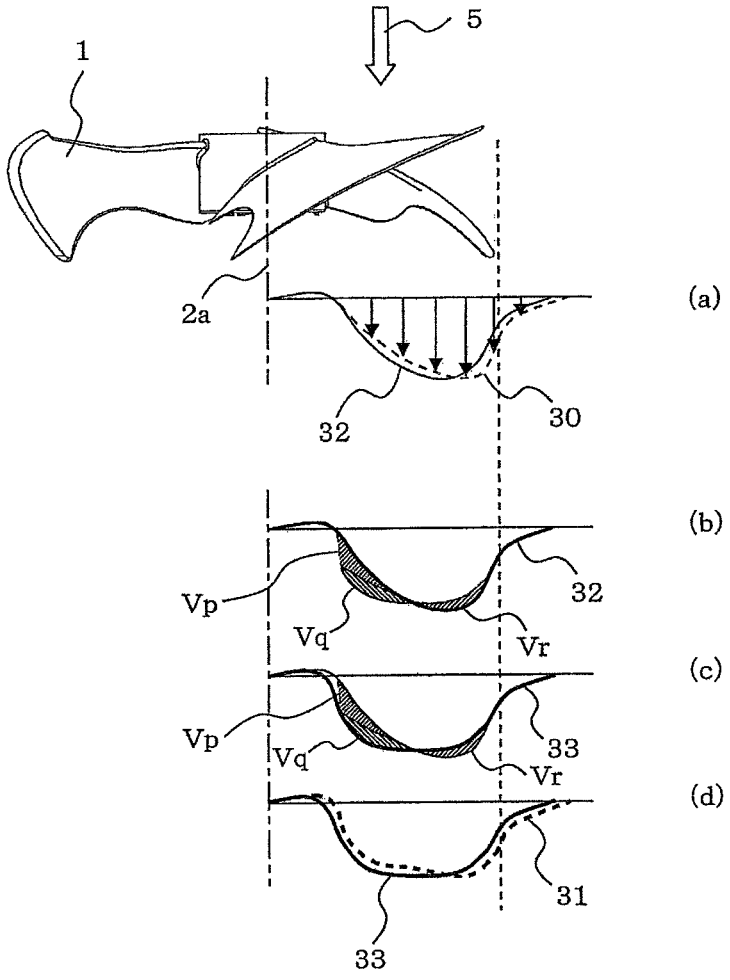
FIG. 10 shows comparative views between the velocity distribution of a forward swept propeller fan according to Embodiment 1 and that of a backward swept propeller fan according to Embodiment 4.

View (a) of FIG. 10 is a comparative view between a velocity distribution (forward swept shape) 30 of the forward swept propeller fan and a velocity distribution (backward swept shape) 32 of the backward swept propeller fan.

At a position where the velocity distribution has a highest velocity (the flow quantity is large), the blown air is pushed by the blade 1 in different directions, as mentioned earlier. Thus, the peak position of the backward swept shape tends to shift more to the inner circumferential side of the blade 1 than the forward swept shape.

Views (b) and (c) of FIG. 10 illustrate the velocity distribution (corrected, backward swept shape) 33 observed when the regions P, Q, and R of the blade 1 according to Embodiment 1 is provided in the backward swept propeller fan according to Embodiment 4. Since the regions P, Q, and R are set on the blade surface, the effects of increasing or reducing the flow velocity are produced in the velocity distribution similarly to Embodiment 1 to obtain a region Vp in which the flow velocity is increased by the effect of the region P, a region Vq in which the flow velocity is increased by the effect of the region Q, and a region Vr in which the flow velocity is reduced by the effect of the region R. Thus, the velocity distribution (corrected, backward swept shape) 33 is obtained.

View (d) of FIG. 10 is a comparative view between the velocity distribution (corrected, forward swept shape) 31 of the forward swept propeller fan according to Embodiment 1 and the velocity distribution (backward swept shape) 33 of the backward swept propeller fan according to Embodiment 4.

As illustrated in view (d) of FIG. 10, in the backward swept propeller fan according to Embodiment 4, by reducing spread of the velocity distribution to the outer circumferential side of the blade 1, the peak of the flow velocity distribution can be reduced on the outer circumferential side to flatten the velocity distribution.

Accordingly, the pressure loss of air blown from the propeller fan is reduced, and accordingly, the drive force required for sending air is reduced. Thus, the power consumption of the motor can be reduced.

Although the chord center line 6 of the backward swept shape is entirely located downstream of the perpendicular plane 7 in the flow of the fluid in the blade shape of the above-described example, the blade 1 still has the functions and produces the effects as described above as long as the blade 1 has a shape in which 70% of the chord center line 6 in length is located downstream of the perpendicular plane 7 in the flow of the fluid.

The structure, in which the propeller fan having the backward swept blades 1 according to Embodiment 4 is attached to motor supports 70, will further be described hereinafter.

Figure 11:
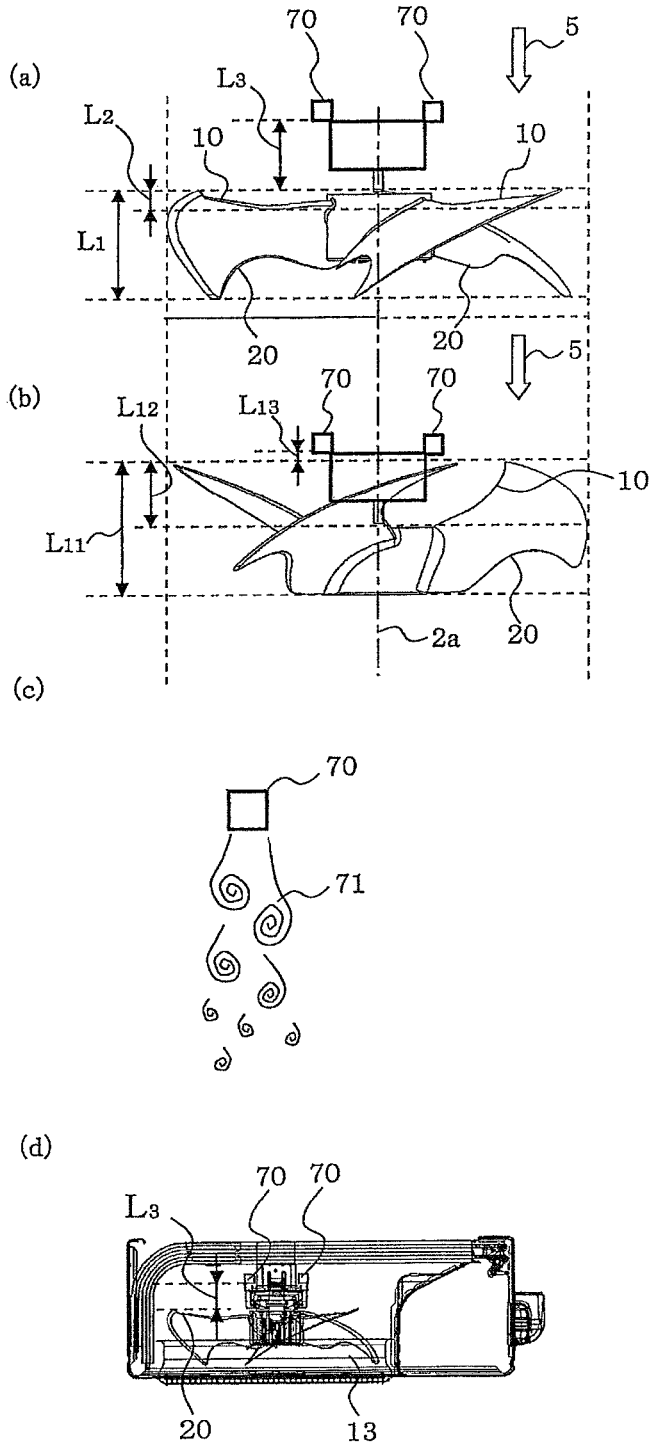
FIG. 11 shows side views in which the propeller fan according to Embodiment 4 is attached to motor supports.

View (a) of FIG. 11 is a side view of the propeller fan according to Embodiment 4 and the motor supports 70, to which the propeller fan is attached.

The above-described backward swept blades 1 each have a shape in which the chord center line 6 is located downstream of the perpendicular plane 7 in the flow of the fluid. In the backward swept propeller fan illustrated in view (a) of FIG. 11, a length L2 of the leading edge 10 in the axis of rotation direction is limited to fall within 20% of a length L1 of the blade 1 in the axis of rotation direction.

View (b) of FIG. 11 is a side view illustrating a forward swept blade 1 for comparison. In this blade 1, a length L12 of the leading edge 10 in the axis of rotation direction does not fall within 20% of a length L11 of the blade 1 in the axis of rotation direction.

View (c) of FIG. 11 illustrates the behavior of a Karman vortex street 71 of the fluid having passed through the motor supports 70.

View (d) of FIG. 11 is a sectional top view of an outdoor unit of an air-conditioning apparatus in which an air-sending device that includes the propeller fan according to Embodiment 4 attached to the motor supports is disposed.

When the propeller fans illustrated in views (a) and (b) of FIG. 11 rotate, the blades 1 move across and cut the Karman vortex street 71 generated downstream of the motor supports 70.

At this time, the Karman vortex street 71, as cut apart, collides with a portion of the blades 1 near the leading edges 10, thereby causing a large pressure fluctuation. As a result, so-called aerodynamic noise is generated. The aerodynamic noise is known to increase noise. The Karman vortex street 71 is attenuated as it moves to the downstream side.

In the forward swept propeller fan illustrated in view (b) of FIG. 11, the length L12 of the leading edge 10 in the axis of rotation direction does not fall within 20% of the maximum length L11 of the blade 1 in the axis of rotation direction. Accordingly, a distance L13 between the outer circumferential side of the leading edge 10 and the motor supports 70 is small. This causes the blade 1 to pass through the strong Karman vortex street 71 generated by the motor supports 70 and to collide with the leading edge 10 of the blade 1. As a result, a large pressure fluctuation occurs on the leading edge 10 so that the aerodynamic noise is increased.

In contrast, in the backward swept propeller fan illustrated in view (a) of FIG. 11, the length L2 of the leading edge 10 in the axis of rotation direction falls within 20% of the maximum length L1 of the blade 1 in the axis of rotation direction, and accordingly, a distance L3 between the outer circumferential side of the leading edge 10 and the motor supports 70 is increased. With this shape, since the Karman vortex street 71 has been attenuated by its movement across a certain distance, the aerodynamic noise can be suppressed even when the blade 1 passes through and cut the Karman vortex street 71.

An outdoor unit of an air-conditioning apparatus attaining low noise can be provided using such a built-in propeller fan, as illustrated in view (d) of FIG. 11.

<Structure to Which Propeller Fans According to Embodiments 1 to 4 Are Applicable>

The detailed structure of the blades 1 that can be added to the propeller fans according to each of Embodiments 1 to 4 will be described next.

[Winglet]

The shape of the outer circumferential edge 12 of the blade 1 according to each of Embodiments 1 to 4 will be described.

Figure 12:
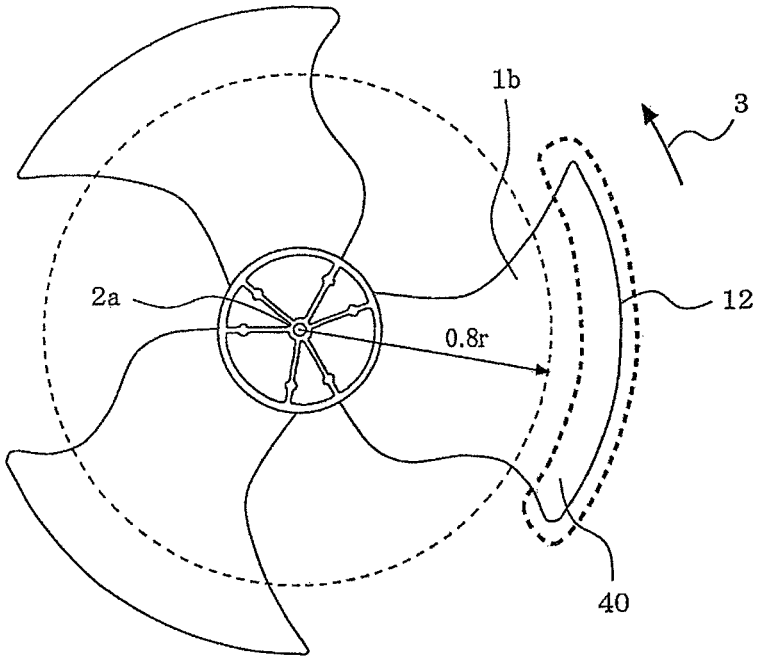
FIG. 12 illustrates views of winglets of the propeller fan according to the present invention.
Figure 12:
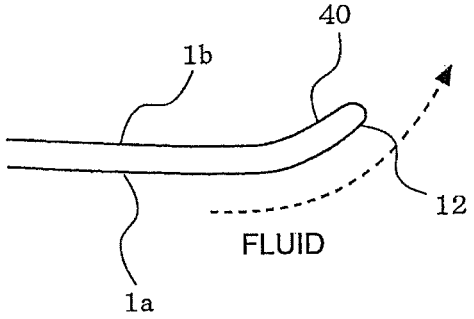

View (a) of FIG. 12 is a front view of the propeller fan as seen from the upstream side of the flow of the fluid.

View (b) of FIG. 12 is a sectional view of the blade of the propeller fan taken in the radial direction.

In views (a) and (b) of FIG. 12, a winglet 40 is formed on the outer circumferential edge 12 of the blade 1. The winglet 40 is bent to the upstream side of the flow of the fluid.

In the propeller fan, when the blade 1 rotates, a flow of the fluid from the high static-pressure side, that is, the side of a pressure surface 1*a* to the low static-pressure side, that is, the side of a suction surface 1*b* is generated on the outer circumferential edge 12 of the blade 1. A wingtip vortex is formed by this flow. The wingtip vortex has a spiral vortex structure.

The wingtip vortex generated in the preceding blade 1 flows into the succeeding blade 1, interferes with the succeeding blade 1, and collides with the wall surface of a bell-mouth disposed around the propeller fan, so that a static pressure fluctuation occurs. This increases noise and motor input. The winglet 40 produces the effect of suppressing the wingtip vortex as illustrated in view (b) of FIG. 12, The winglet 40 allows the fluid to smoothly flow from the high static-pressure side, that is, the side of the pressure surface 1*a* to the low static-pressure side, that is, the side of the suction surface 1*b* of the blade 1 along its curved portion.

It is desirable that letting r be the radius of the blade 1 having as its center the axis of rotation 2*a*, the winglet 40 should be disposed more to the outer circumferential side than a position that is separated from the axis of rotation 2*a* by 0.8r. This is done to allow the winglet 40 to produce effects of both suppressing the wingtip vortex and improving the bending strength of the blade 1.

With such a winglet 40, the occurrence of a wingtip vortex and the pressure fluctuation occurring when the blade 1 passes at high speed near the bell-mouth are suppressed to reduce noise.

[Cross-sectional Shape of Trailing Edge]

The cross-sectional shape of the trailing edge 20 of the blade 1 according to each of Embodiments 1 to 4 will be described.

Figure 13:
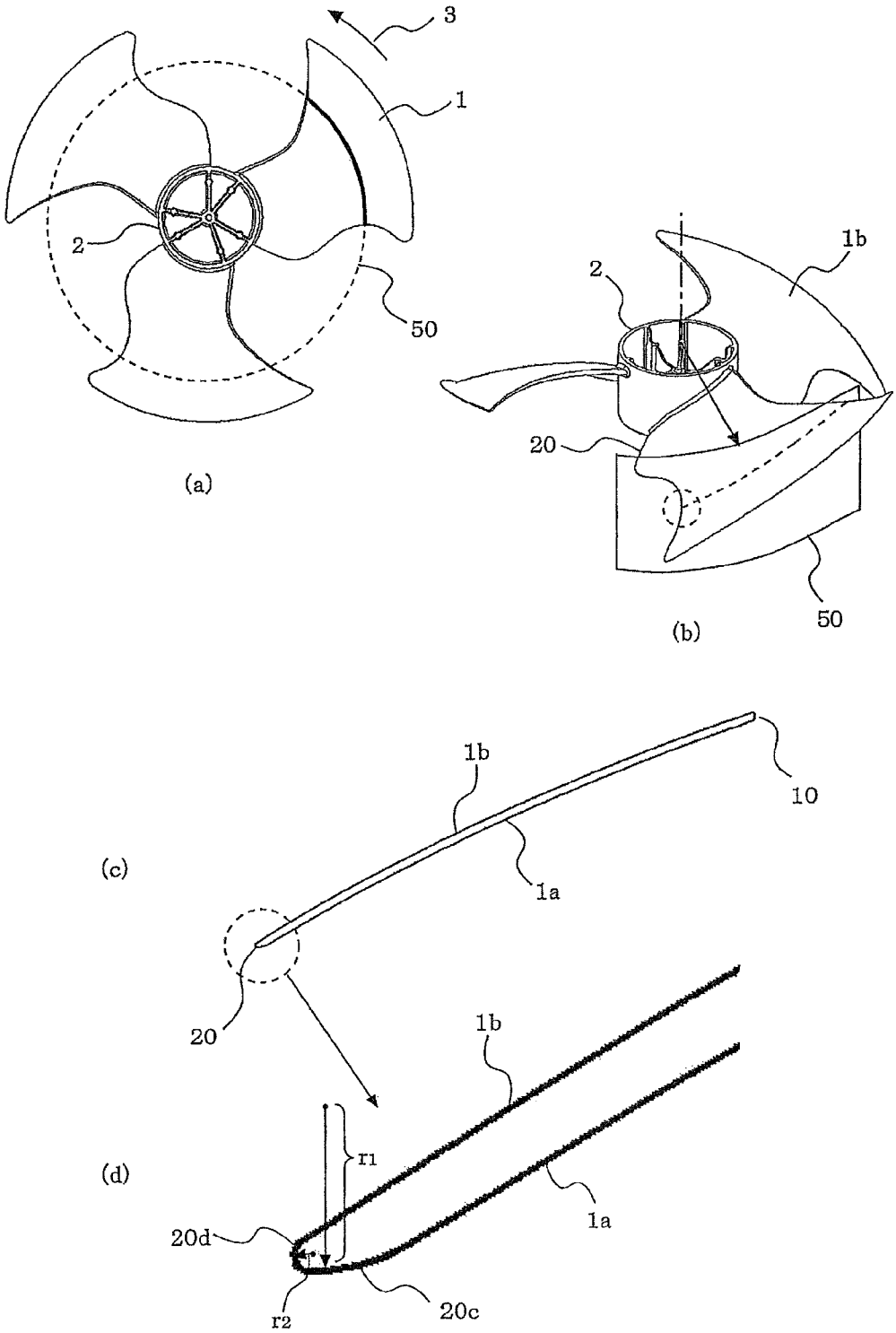
FIG. 13 illustrates views for explaining the cross-sectional shape of a trailing edge of the blade of the propeller fan according to the present invention.

FIG. 13 illustrates views of the cross-sectional shape of the trailing edge 20 of the blade 1.

View (a) of FIG. 13 is a front view illustrating a cross-sectional position 50 of the propeller fan.

View (b) of FIG. 13 is a perspective view illustrating the cross-sectional position 50 of the propeller fan.

View (c) of FIG. 13 is a sectional view of the blade 1 as seen from the cross-sectional position 50 illustrated in views (a) and (b) of FIG. 13.

View (d) of FIG. 13 is an enlarged sectional view of the trailing edge 20 of the blade 1 illustrated in view (c) of FIG. 13.

The cross-section of the blade 1 illustrated in views (c) and (d) of FIG. 13 has the cross-sectional shape of the blade 1 as seen from the cross-sectional position 50 illustrated in (a) and (b) of FIG. 13.

As illustrated in view (c) of FIG. 13, the blade 1 has the pressure surface 1*e* and the suction surface 1*b*. The cross-section of the trailing edge 20 of the blade 1 has two arcs, that is, a first arc 20*c* and a second arc 20*d*, as illustrated in view (d) of FIG. 13.

Note that in the blade cross-section, a cross-sectional radius r1 of the first arc 20*c* continuous with the pressure surface 1*a* is specified to be larger than a cross-sectional radius r2 of the second arc 20*d* continuous with the suction surface 1*b*.

Figure 14:
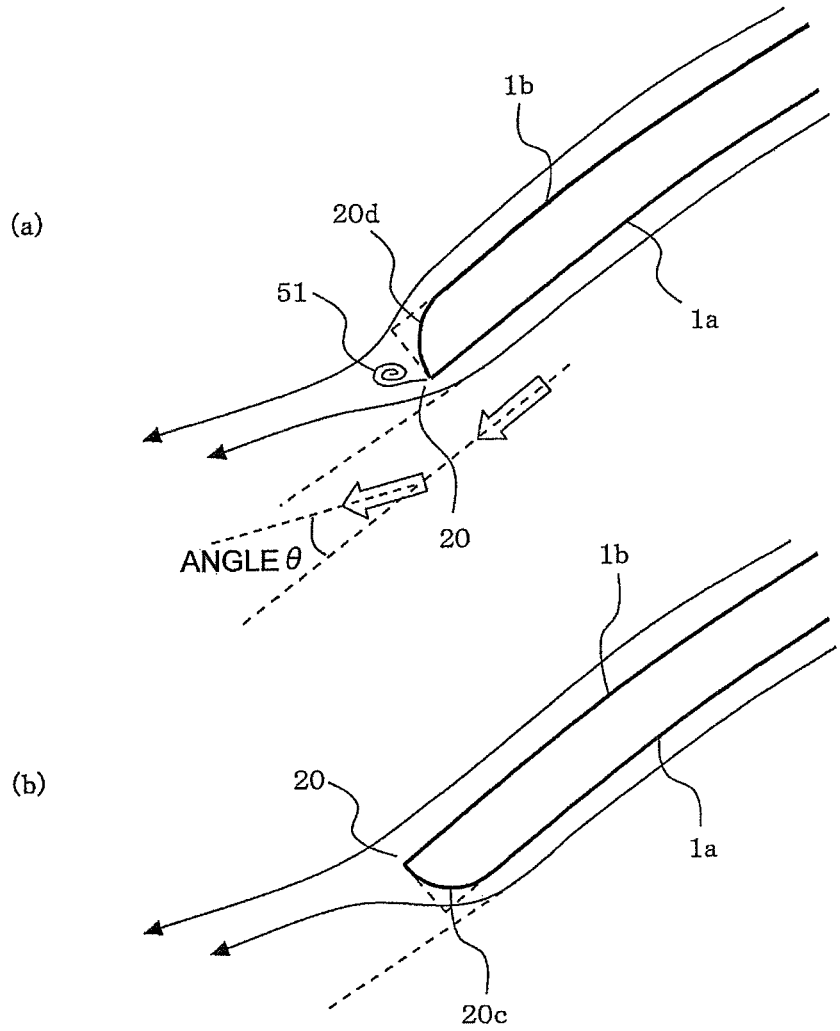
FIG. 14 shows sectional views of the cross-sectional shape of the trailing edge of the blade of the propeller fan according to the present invention.

FIG. 14 shows sectional views of the cross-sectional shape of the trailing edge 20 of the blade 1.

In order to clearly describe the difference in the flow of the fluid corresponding to the cross-sectional radii of the first arc 20*c* and the second arc 20*d* of the trailing edge 20, in the cross-section of the blade 1 illustrated in view (a) of FIG. 14, the cross-sectional radius r1 of the first arc 20*c* on the side of the pressure surface 1*a* is set small (to zero, which represents a right-angled cross-section) and the cross-sectional radius r2 of the second arc 20*d* on the side of the suction surface 1*b* is set large. In contrast, in view (b) of FIG. 14, the cross-sectional radius r1 of the first arc 20*c* on the side of the pressure surface 1*a* is set large, and the cross-sectional radius r2 of the second arc 20*d* on the side of the suction surface 1*b* is set small (to zero, which represents aright-angled cross-section).

Streamlines near the blade surface are illustrated in views (a) and (b) of FIG. 14. The fluid pushed on the pressure surface 1*a* changes its direction to flow, when it moves from the trailing edge 20 of the blade 1. The angle of shift at this time is defined as an angle θ in view (a) of FIG. 14.

In doing so, in the cross-sectional shape of the trailing edge 20 illustrated in view (a) of FIG. 14, the first arc 20*c* on the side of the pressure surface 1*a* does not exist, and only the second arc 20*d* of the cross-sectional radius r2 on the side of the suction surface 1*b* is formed. With this structure, since the trailing edge 20 on the side of the pressure surface 1*a* has an edge-shaped cross-section, the fluid moving from the trailing edge 20 is caught by the trailing edge 20, thereby generating a separation region 51 of the fluid.

As illustrated in view (b) of FIG. 14, the first arc 20*c* having the cross-sectional radius r1 is formed on the trailing edge 20 on the side of the pressure surface 1*a* in the blade 1 according to each of Embodiments 1 to 4. Thus, even when the direction in which the fluid flows changes, the fluid smoothly flows along the first arc 20*c* having the large cross-sectional radius r1, and accordingly, the separation region 51 is not generated. Thus, the separation of the fluid on the trailing edge 20 is suppressed and the energy loss of the fluid is reduced. This reduces the drive force for rotating the propeller fan and the power consumption of the motor.

Although the cross-sectional shape of the entire trailing edge 20 has the first arc 20*c* and the second arc 20*d* in the above-described example, it may be applied only to the third curved portion 20*b* on the outer circumferential side, which is a region where the flow velocity is high in the trailing edge 20.

[Shape of Connection of Trailing Edge and Boss]

The shape of a connecting portion 60, where the boss 2 and the inner circumferential side of the trailing edge 20 are connected to each other, according to each of Embodiments 1 to 4 will be described.

Figure 15:
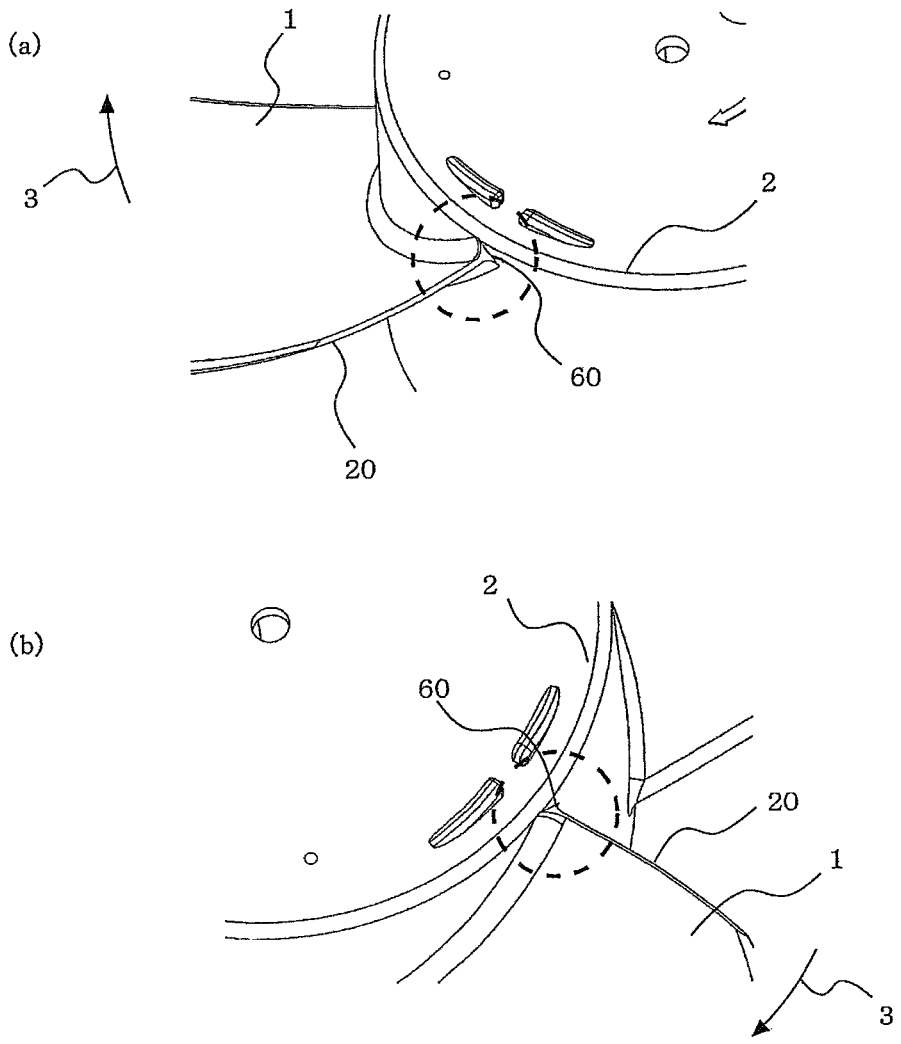
FIG. 15 shows perspective views of a position where the trailing edge of the blade according to the present invention and a boss are connected to each other.

Views (a) and (b) of FIG. 15 are perspective views of a position where the trailing edge 20 of the blade 1 and the boss 2 are connected to each other.

Referring to FIG. 15, the connecting portion 60, where the trailing edge 20 of the blade 1 and the boss 2 are connected to each other, has an edge shape that is not rounded and has a valley fold line.

The reason for this will be given with reference to FIG. 16.

Figure 16:
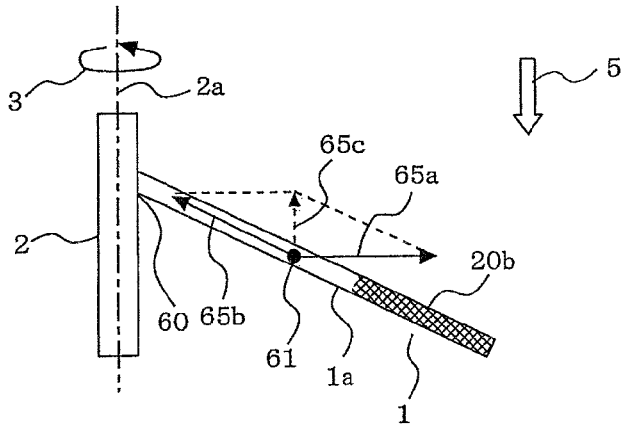
FIG. 16 illustrates forces applied to a connecting portion, where the trailing edge of the blade and the boss are connected to each other, when the blade according to the present invention rotates.

FIG. 16 illustrates forces applied to the connecting portion 60, where the trailing edge 20 of the blade 1 and the boss 2 are connected to each other, when the blade 1 rotates.

Referring to FIG. 16, when the blade 1 attached to the circumferential surface of the boss 2 rotates in the rotational direction 3, a centrifugal force 65*a* and a tensile force 65*b*, with which a center of gravity 61 of the blade 1 is pulled by the boss 2, act on the center of gravity 61 of the blade 1, Thus, a resultant force 65*c* of these forces acts on the center of gravity 61 of the blade 1. Hatching in FIG. 16 indicates the third curved portion 20*b* that reduces the blade area in the trailing edge 20 of the blade 1.

As illustrated in FIG. 16, the vector of the resultant force 65*c* is directed to the upstream side in the fluid flow direction 5 in which the fluid flows. Thus, the tensile force acts on the connecting portion 60 where the trailing edge 20 of the blade 1 and the boss 2 are connected to each other.

As is generally known, it is often the case that, when the propeller fan is formed of resin or the like, cracks develop from portions to which tensile forces are applied, resulting in breakage of propeller fans. In order to avoid such a situation, it is desirable that the center of gravity 61 should be positioned near the boss 2.

The centrifugal force is given by a fundamental equation as:

$$F = m \cdot a = m \cdot (v \cdot \omega) = m \cdot r \cdot \omega^2 = m \cdot \frac{v^2}{r} \quad \text{[Math. 5]}$$

where F is the centrifugal force, m is the mass, a is the acceleration, v is the velocity, and ω is the angular acceleration.

When the effects on the centrifugal force 65*a* produced on the inner circumferential side of the blade 1 are compared with those on the outer circumferential side of the blade 1, it can be understood that, although the mass on the outer circumferential side and that on the inner circumferential side are the same, the mass on the outer circumferential side has an influence at a higher rate on the centrifugal force 65*a* than that on the inner circumferential side because the radius r is a multiplier. That is, the smaller the mass at a position farther than the axis of rotation 2*a*, the smaller the centrifugal force 65*a*, and accordingly, the smaller the resultant force 65*c* can become.

In the propeller fan according to each of Embodiments 1 to 4, with the third curved portion 20*b*, which reduces the area of the blade 1, on the outer circumferential side of the blade 1 on the trailing edge 20 of the blade 1, the effects on the centrifugal force 65*a* can be reduced. Thus, the tensile force applied to the connecting portion 60, where the trailing edge 20 and the boss 2 are connected to each other, is reduced. Accordingly, the tensile force can be addressed even when the connecting portion 60 has the edge shape that is not rounded and has the valley fold line.

Accordingly, the amount of resin for a rounding process can be reduced to obtain a lightweight fan, and the power consumption of the motor, in turn, can be reduced.

[Packing of Propeller Fans]

Packing of propeller fans according to each of Embodiments 1 to 4 will be described.

Figure 17:
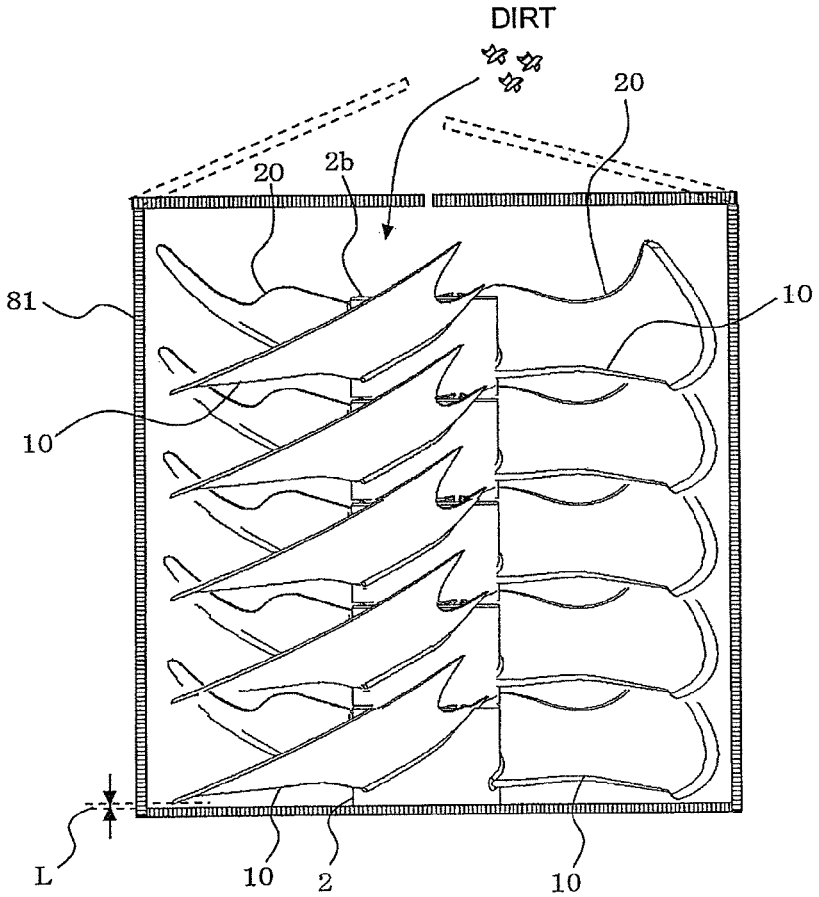
FIG. 17 is a schematic view illustrating how the propeller fans according to the present invention are packed.

FIG. 17 is a schematic view illustrating how propeller fans are packed.

Referring to FIG. 17, a stack of propeller fans is contained in a cardboard box 81 for packing. A leading edge 10 of a blade 1 keeps a distance L from the bottom surface of the cardboard box 81. Furthermore, the stack of propeller fans is packed so as to put lid surfaces 2*b* of the bosses 2 face up.

Since the propeller fans are packed as described above, when the cardboard box 81 having been transported by truck and delivered to the factory is opened, contamination adhering to the cardboard, dust, dirt, and the like floating in the factory can be prevented from entering the bosses 2.

Thus, unstable rotation or noise due to deviation of the shaft center of the propeller fan, which is caused by the dirt caught between the axial hole of the boss 2 and the motor shaft, can be avoided.

[Propeller Fan without Boss]

Figure 18:
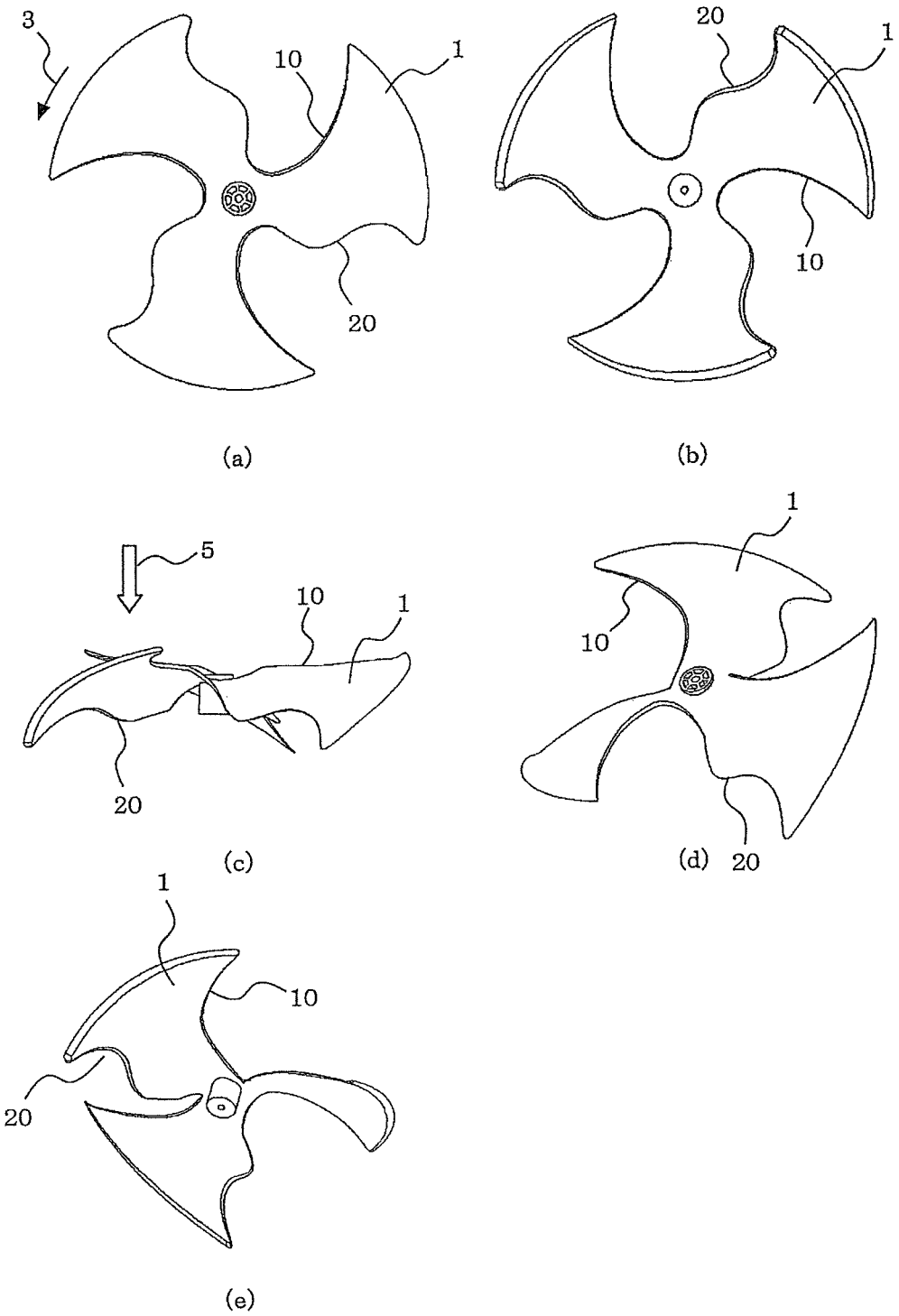
FIG. 18 shows schematic views for explaining the shape of a propeller fan without a boss using the blades according to the present invention.

FIG. 18 shows schematic views for explaining the shape of a propeller fan without a boss using the blades according to the present invention.

Figure 19:
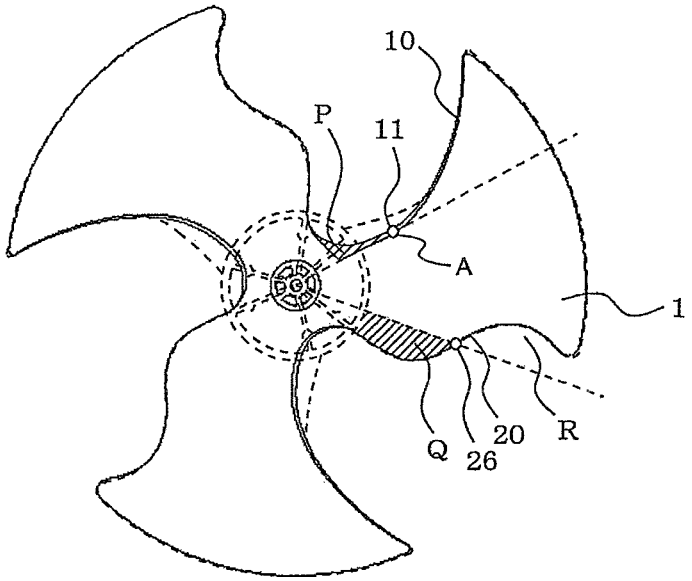
FIG. 19 is a front view for explaining the shape of the propeller fan without a boss using the blades according to the present invention.

FIG. 19 is a front view for explaining the shape of the propeller fan without a boss using the blades according to the present invention.

Although the example of the propeller fan includes a boss, and the blades 1 are attached to the circumferential surface of the boss 2 in Embodiments, the structure of the blade 1 according to Embodiments can be applied to a propeller fan without a boss as illustrated in FIGS. 18 and 19.

Even when a propeller fan without a boss is used, the velocity distribution of the flow in the rotational direction over the positions in the radial direction of the blade 1 is flattened by forming the regions P, Q, and R in the blade 1 as illustrated in FIG. 19. This reduces the pressure loss of air blown from the propeller fan. Thus, the drive force for rotating the propeller fan can be reduced, and accordingly, the power consumption of the motor can be reduced.

[Application to Outdoor Unit]

Figure 20:
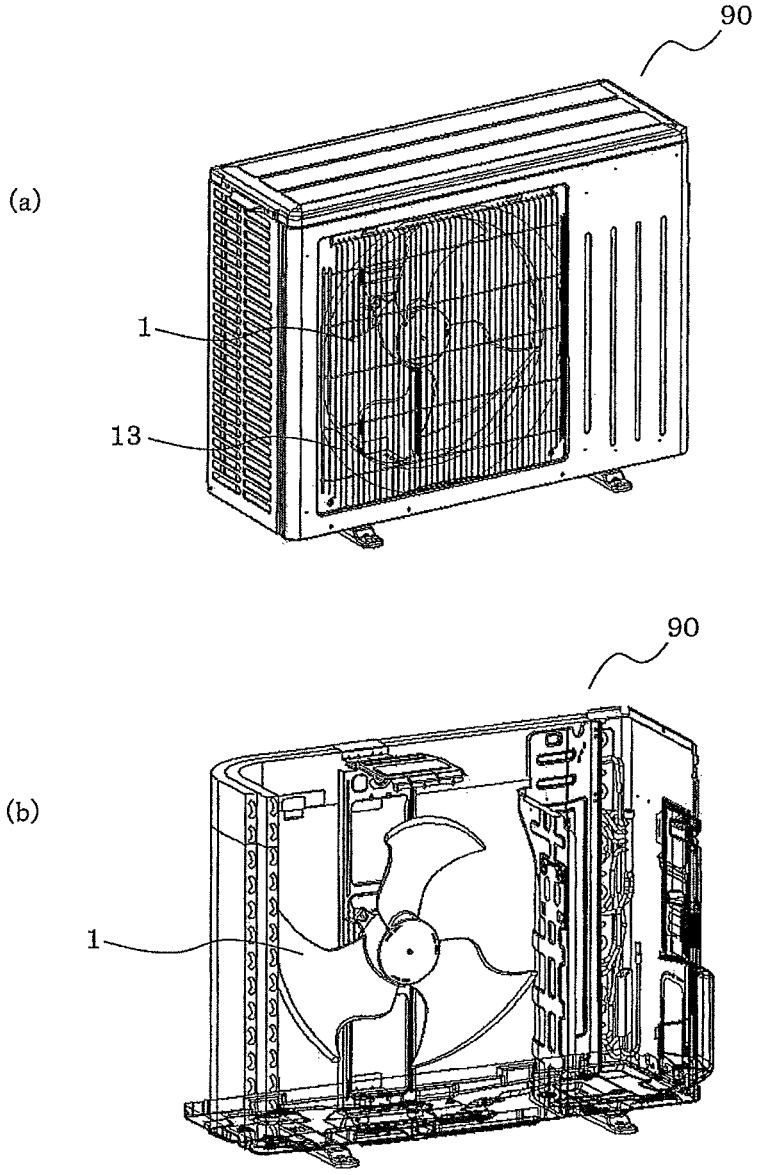
FIG. 20 shows perspective views of an outdoor unit of an air-conditioning apparatus using the propeller fan according to the present invention.
Figure 21:
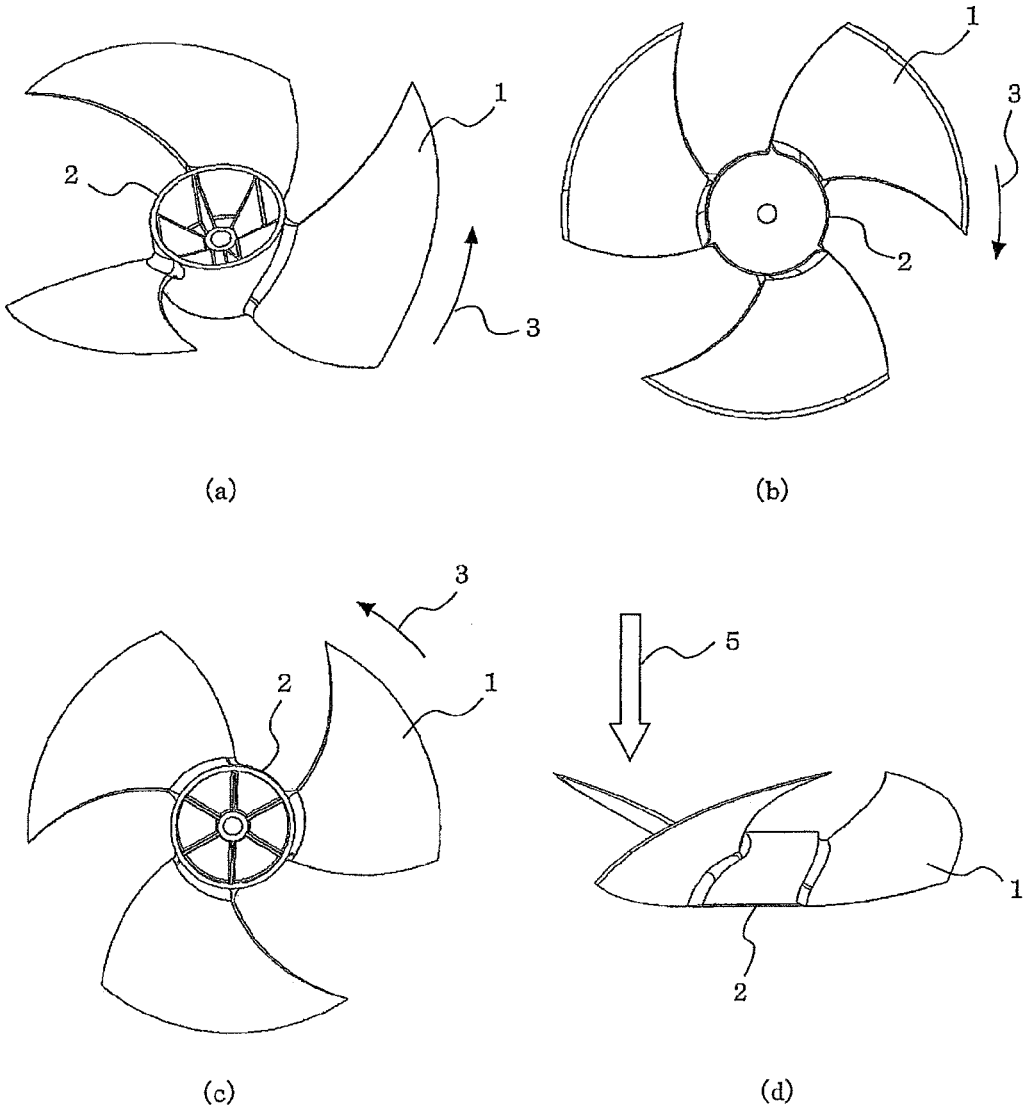
FIG. 21 shows views for explaining the shape of a related-art propeller fan.
Figure 22:
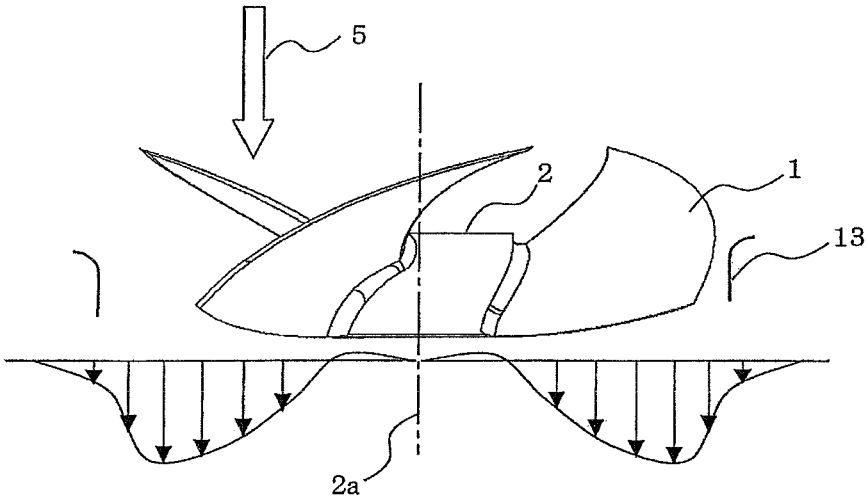
FIG. 22 illustrates the velocity distribution of the flow in a direction along an axis of rotation over positions in the radial direction of a blade of the related-art propeller fan.

Views (a) and (b) of FIG. 20 are perspective views illustrating an outdoor unit of an air-conditioning apparatus using the propeller fan according to the present invention.

The propeller fan according to each of Embodiments 1 to 4 used for an outdoor unit 90 is disposed in the outdoor unit 90 together with a bell-mouth 13 and sends outdoor air to an outdoor heat exchanger for exchanging heat. In doing so, since the velocity distribution of blown air in the axis of rotation direction is equalized over the positions in the radial direction of the blade of the propeller fan, the outdoor unit 90 featuring a reduced pressure loss and reduced power consumption can be realized.

The blade shape of the propeller fan described in Embodiments can be used in various air-sending devices. Other than the outdoor unit, for example, the blade shape of the propeller fan can be used in an indoor unit of the air-conditioning apparatus. Furthermore, the blade shape of the propeller fan according to Embodiments can be widely applied to the blade shapes of, for example, general air-sending devices, ventilating fans, pumps, and axial flow compressors that deliver a fluid.

REFERENCE SIGNS LIST

1 blade, 1*a* pressure surface, 1*b* suction surface, 2 boss, 2*a* axis of rotation, 2*b* lid surface, 3 rotational direction, 4 inflow direction, 5 fluid flow direction, 6 chord center line, 6*a* contact point, 7 perpendicular plane, 8A, 8B, SC virtual line, 9 concentric circle, 9*a* first concentric circle, 9*b* second concentric circle, 10 leading edge, 10*a* first curved portion, 11 leading-edge rearmost point, 12 outer circumferential edge, 13 bell-mouth, 14 streamline limit, 15 fluid pushing direction, 20 trailing edge, 20*a* second curved portion, 20*b* third curved portion, 20*c* first arc, 20*d* second arc, 23 trailing-edge foremost point, 24 trailing-edge rearmost point, 25 first intersection, 26 inflection point, 27 second intersection, 40 winglet, 50 cross-sectional position, 51 separation region, 60 connecting portion, 61 center of gravity, 65*a* centrifugal force, 65*b* tensile force, 65*c* resultant force, 70 motor support, 71 Karman vortex street, 81 cardboard box, and 90 outdoor unit.

The invention claimed is:

1. An axial flow fan comprising:

a plurality of blades rotated to deliver a fluid from an upstream side to a downstream side of a flow of the fluid in a direction along an axis of rotation, each of the plurality of blades including:

a first curved portion formed on a leading edge on a forward side of the blade in a rotational direction in which the blade rotates, the first curved portion protruding backwards in the rotational direction in a planar image of the blade as projected in the direction along the axis of rotation, and the first curved portion having a leading-edge rearmost point as a point of contact where the first curved portion is in contact with a virtual line that extends perpendicularly to the axis of rotation;

a second curved portion formed on a trailing edge on a backward side of the blade in the rotational direction, the second curved portion being located on an inner circumferential side of the trailing edge and protruding backwards in the rotational direction in a planar image of the blade as projected in the direction along the axis of rotation; and a third curved portion formed on the trailing edge on the backward side of the blade in the rotational direction, the third curved portion being located on an outer circumferential side of the blade on the trailing edge and protruding forwards in the rotational direction in a planar image of the blade as projected in the direction along the axis of rotation, the third curved portion having a trailing-edge foremost point as a point of contact where the third curved portion is in contact with another virtual line that extends perpendicularly to the axis of rotation, and the second curved portion having a trailing-edge rearmost point at which a length of a perpendicular line dropped to the other virtual line that passes through the axis of rotation and the trailing-edge foremost point takes a maximum, wherein a first intersection that is an intersection between the trailing edge and a first concentric circle, which is one of concentric circles having as their center the axis of rotation and passes through the leading-edge rearmost point, is located between the trailing-edge rearmost point and the trailing-edge foremost point.

2. The axial flow fan of claim 1, wherein the second curved portion and the third curved portion are connected to each other at an inflection point at which a direction of curvature changes, and wherein the inflection point is more to the outer circumferential side of the blade than the first intersection on the trailing edge.

3. The axial flow fan of claim 2, wherein the inflection point is located between the first intersection and a second intersection at which the trailing edge intersects a second concentric circle having a radius greater than a radius of the first concentric circle by 0.1 times a distance between the axis of rotation and an outer circumferential edge of the blade.

4. The axial flow fan of claim 1, wherein the second curved portion and the third curved portion are connected to each other at an inflection point at which a direction of curvature changes, and wherein the leading-edge rearmost point and the inflection point are located on the first concentric circle.

5. The axial flow fan of claim 1, wherein the blade has a backward swept blade shape, in which not less than 70% of a length of a chord center line of the blade is located downstream of a perpendicular plane, which extends in a direction perpendicular to the axis of rotation from a position where the chord center line is in contact with a circumferential surface of a boss, in the flow of the fluid.

6. The axial flow fan of claim 1, wherein the blade has a backward swept blade shape, in which a chord center line of the blade is entirely located downstream of a perpendicular plane, which extends in a direction perpendicular to the axis of rotation from a position where the chord center line is in contact with a circumferential surface of a boss, in the flow of the fluid.

7. The axial flow fan of claim 1, wherein the blade has, on an outer circumferential edge of the blade, a winglet bent to the upstream side of the flow of the fluid.

8. The axial flow fan of claim 7, wherein the winglet is formed in a region of the blade that has as a center the axis of rotation and is more to the outer circumferential side than a region having as its center the axis of rotation and a radius that is 80% of a radius of the blade.

9. The axial flow fan of claim 1, wherein the blade has a pressure surface that collides with the fluid and a suction surface on a rear side of the pressure surface, wherein, in a cross-section of the trailing edge of the blade, the blade has a first arc continuous with the pressure surface and a second arc continuous with the suction surface, and wherein a radius of the first arc is greater than a radius of the second arc.

10. The axial flow fan of claim 1, wherein a circumferential surface of a boss and the trailing edge of the blade are connected to each other so as to form an edge shape having a valley fold line.

11. The axial flow fan of claim 1, wherein a length of the leading edge of the blade in the direction along the axis of rotation falls within 20% of a maximum length of the blade in the direction along the axis of rotation, and wherein a motor support configured to support a drive motor stands upright on a side of the leading edge of the blade.

12. The axial flow fan of claim 1, wherein the axial flow fan includes an axial flow fan without a boss.

13. An air-conditioning apparatus comprising an axial flow fan, the axial flow fan comprising:

a plurality of blades rotated to deliver a fluid from an upstream side to a downstream side of a flow of the fluid in a direction along an axis of rotation, each of the plurality of blades including:

a first curved portion formed on a leading edge on a forward side of the blade in a rotational direction in which the blade rotates, the first curved portion protruding backwards in the rotational direction in a planar image of the blade as projected in the direction along the axis of rotation, and the first curved portion having a leading-edge rearmost point as a point of contact where the first curved portion is in contact with a virtual line that extends perpendicularly to the axis of rotation;

a second curved portion formed on a trailing edge on a backward side of the blade in the rotational direction, the second curved portion being located on an inner circumferential side of the trailing edge and protruding backwards in the rotational direction in a planar image of the blade as projected in the direction along the axis of rotation; and a third curved portion formed on the trailing edge on the backward side of the blade in the rotational direction, the third curved portion being located on an outer circumferential side of the blade on the trailing edge and protruding forwards in the rotational direction in a planar image of the blade as projected in the direction along the axis of rotation, the third curved portion having a trailing-edge foremost point as a point of contact where the third curved portion is in contact with another virtual line that extends perpendicularly to the axis of rotation, and the second curved portion having a trailing-edge rearmost point at which a length of a perpendicular line dropped to the other virtual line that passes through the axis of rotation and the trailing-edge foremost point takes a maximum, wherein a first intersection that is an intersection between the trailing edge and a first concentric circle, which is one of concentric circles having as their center the axis of rotation and passes through the leading-edge rearmost point, is located between the trailing-edge rearmost point and the trailing-edge foremost point.

* * * * *